US006421853B1

(12) United States Patent
Pecorelli et al.

(10) Patent No.: US 6,421,853 B1
(45) Date of Patent: Jul. 23, 2002

(54) STRETCHER FOR THE CLEANSING OF BEDRIDDEN PATIENTS

(76) Inventors: Edgardo René Pecorelli; Edgardo Luis Pecorelli, both of Quiroga 78, Bragado (AR), 6670

( * ) Notice: Subject to any disclaimer, the term of this patent is extended or adjusted under 35 U.S.C. 154(b) by 0 days.

(21) Appl. No.: 09/599,845

(22) Filed: Jun. 22, 2000

(30) Foreign Application Priority Data

Jun. 24, 1999 (AR) ..... 990103034

(51) Int. Cl.[7] ..... A47K 3/06

(52) U.S. Cl. ..... 5/606; 5/900; 5/928; 5/611; 4/585

(58) Field of Search ..... 4/585, 546, 547, 4/570; 5/606, 611, 900, 928

(56) References Cited

U.S. PATENT DOCUMENTS 3,719,962 A * 3/1973 Burkley ..... 5/606
4,002,330 A * 1/1977 Johansson ..... 5/606
4,142,259 A * 3/1979 Moore ..... 5/928
4,577,354 A * 3/1986 Stratton ..... 4/585
4,713,850 A * 12/1987 Flaherty et al. ..... 4/585
5,285,539 A * 2/1994 Anderson et al. ..... 4/564.1
5,598,590 A * 2/1997 Crawford et al. ..... 5/928
5,704,083 A * 1/1998 Nerg ..... 5/606
5,909,970 A * 6/1999 Velazquez ..... 5/606 X

* cited by examiner

*Primary Examiner*—Michael F. Trettel
(74) *Attorney, Agent, or Firm*—Baker Botts LLP

(57) ABSTRACT

An improvement to gurneys for cleaning patients confined to bed which generally is comprised of a structure with legs having caster wheels, which includes, generally, a framework for affixing a table to support the patient with a washing basin comprised of a piece of flexible and collapsible laminar material, attached to the frame, which follows the perimeter of the support table and is connected to form walls that delimit a space for washing. The improvement is comprised of a frame that includes elongations at the ends of its longitudinal sides, which project vertically above the table with rows of notches to affix and hold the upper edge of the laminar piece and to delimit the washing space. These elongations may be comprised of extensions of the ends of the longitudinal sides of the frame in a U shape, formed with vertical inclined sections joined below the frame, of which one, the furthest from the frame, projects above the table to incorporate the row of affixing notches for the laminar material piece. These elongations may also be formed of bars, perpendicular to the opposite ends of the longitudinal sides of the frame, which incorporate the row of notches.

3 Claims, 4 Drawing Sheets

STRETCHER FOR THE CLEANSING OF BEDRIDDEN PATIENTS

BACKGROUND OF THE INVENTION

The periodic cleaning of patients confined to bed is problematic due to the lack of motor functions or muscular insensitivity, and, in general, cleaning is performed in the bed where the patient is confined which causes significant problems because the bed, despite the care used, receives part of the fluid with which the patient is cleaned, which necessitates changing the bedclothes, further disturbing the patient.

Accordingly, there is a great need for a gurney which allows for the complete cleansing of the bodies of the ill who are confined to bed to be used in private houses, as well as in hospitals, nursing homes and homes for the aged, which includes specific structural features to be able to perform such cleaning without physical disturbance to the patient from the head down to the feet, and without subjecting them to extremely bothersome movements such as those used for bathing in bed.

SUMMARY OF THE INVENTION

It is an object of the present invention to provide a gurney which offers cleaning capabilities based on the use of a perforated table superimposed on a washing liquid collection container, and a laminar material piece that delimits a space, in the manner of a basin for such cleaning, which can be withdrawn or collapsed to place the patient on the gurney and to transfer him to the bed once cleaned.

The present invention refers to a gurney for cleansing patients confined to bed, particularly, to an adjustable height bathing gurney to be positioned at bed level to transfer the patient from the bed to it, or from this height to the gurney, so as to be able to proceed with bathing the patient, while keeping the bed dry and clean.

The gurney of the present invention includes, generally, an upper frame to which a support assembly with casters is attached; a table for supporting the patient in a flat position attached to the frame and containing openings along its entire surface; a container attached to the lower surface of the table, the opening of which follows the perimetral contour of the table; and an annular piece made of an elasticized or collapsible laminar material, affixed at its lower edge hermetically between the table and the edge of the container. In a first position, the laminar material forms a wall which encircles the table to delimit a space for cleaning the patient by pouring washing fluid, which is drained through the openings of the table to the container. In a second position, the laminar material forms, by withdrawal or folding of that piece below the table, a free space on it to transfer the patient.

In a first embodiment of the improved gurney, the upper frame has at the ends of its longitudinal sides respective bent extensions in a U-shape located below the table. A free arm of each U-shape extends upward above the table and has rows of engaging grooves to receive the upper edge of the laminar material piece to support it in an elevated position. The free arms are connected to conventional gripping handles to position the gurney and a bar with a hilt for pushing. Attached to the frame, at spaced points, on opposite longitudinal sides, are hinged support leg flanges comprised of pairs of members connected to each other, the lower of which has a spinning hinged support to that member and contains a wheel, with the hinged axles of the leg members interconnected by a threaded bar with an operating handle to vary the angular position of the members with respect to each other, so as to lower or raise the patient support table. This foldable lower support structure allows the gurney to easily fit into small spaces and elevators.

In a second embodiment of the improved gurney, the table support frame has, at opposite ends of longitudinal sides, respective pairs of vertical bars with engaging grooves for the laminar material piece, with the respective pairs of vertical bars being joined by a gripping handle. On the opposite ends of the sides thereof, the frame has hinging points for pairs of leg members obliquely intercrossing, and which are connected at the bottom edges thereof to a bottom frame furnished with casters. Each leg member has an intermediate nut for attaching a screw rod, which has a manual lever for angularly changing the intercrossing or said members, thus lowering or lifting the stretcher.

BRIEF DESCRIPTION OF THE DRAWING FIGURES

DETAILED DESCRIPTION OF THE INVENTION

Figure 1:
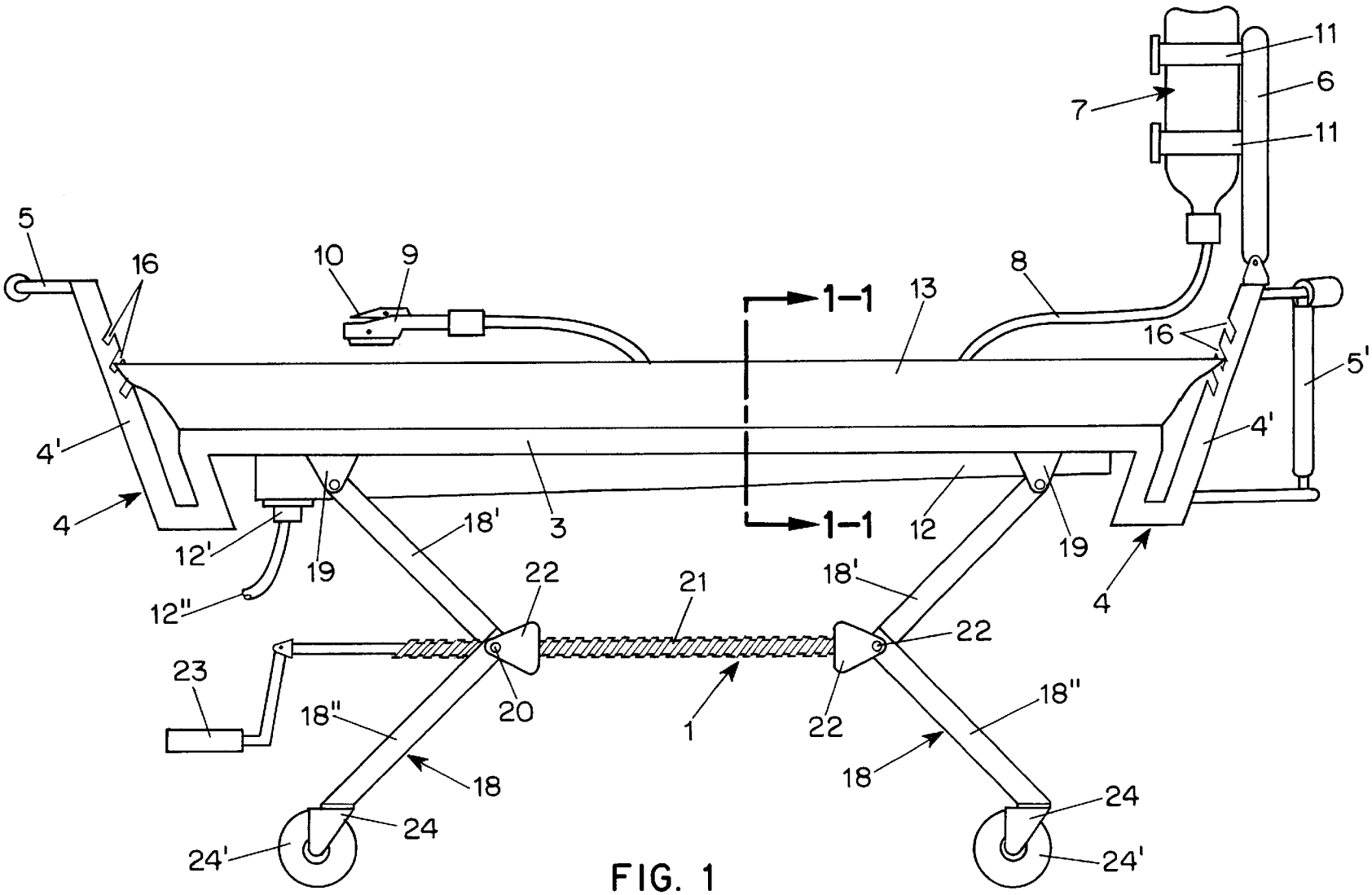
FIG. 1 is an elevation view of a first embodiment of the gurney for cleaning patients confined to bed.
Figure 2:
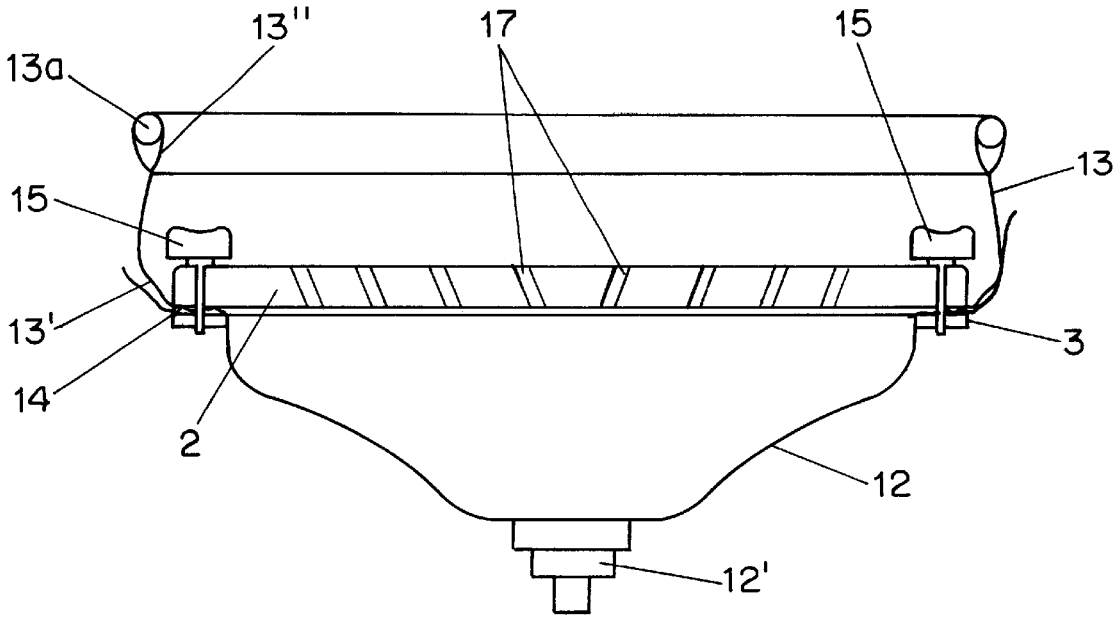
FIG. 2 is a transverse view cut by line 1—1 of FIG. 1, showing the connection of the laminar material piece that delimits the cleaning space on the table.

Pursuant to the drawings, particularly in FIGS. 1 and 2 representing a first embodiment of the present invention, the gurney includes a support structure 1, for a table 2 made of an elastically deformable material in a general rectangular shape and designed to support the patient in a flat position while cleaning him.

The structure of support 1 includes a frame 3 to support or affix table 2. The frame has at opposite ends of its longitudinal sides respective extensions 4 in a U-shape which have, in turn, respective free arms 4' which extend vertically, inclined above frame 3. The extensions 4 of one end of frame 3 are joined respectively by a transversal bar 5, to push the gurney. Vertical hilt 5' has hinged and retractable bars 6 to support a container 7 containing fluid with an approximate capacity of 10 liters. Container 7 has an output tube 8 which has at its free end a shower attachment 9, with a fluid drain stop 10, which allows the fluid to be distributed over the patient's body. Container 7 is affixed to bars 6 with clamps 11 to allow it to be replaced or filled.

Affixed to frame 3 is a container 12, which is connected to the table 2. The container has an open upper portion to delimit a mouth, whose edge follows the perimetral contour of table 2. The container 12 has a drain 12' with a tube 12" to discharge the washing fluid.

Between the underside of table 2 and the upper surface of the mouth of container 12, there extends above frame 3, a lower area 13' of an elasticized laminar material piece 13, which is attached to frame 3 and table 2, with the interplacement of a sealing gasket 14, using thumbscrews 15. This laminar material 13 has an upper edge 13" which receives a bar **13*a* which allows laminar piece 13 to catch in notches or grooves 16 made in the free arms 4' of the extensions 4, so as to form a perimeter wall around table 1 which surrounds the patient during cleaning or spreading the fluid. The fluid drains into container 12 through openings or holes 17 in table 2**.

The gurney's support structure 1, in this configuration, is foldable and especially adaptable to be used in apartment houses and to be placed without problems in elevators. This structure 1 is comprised of legs 18 formed by pairs of bars, tubes or similar members 18'–18," hinged through one of its members 18' to small plates 19, located at opposite ends of the longitudinal sides of frame 3, and on opposite sides of container 12. The hinging points of members 18'–18" on legs 18, facing each other, are joined by axles 20, connected by a threaded bar 21 through nuts 22. The threaded bar 21 has a handle 23, for operation which allows the angle between members 18'–18" to change, thereby changing the height of the gurney with respect to the level of the bed so that the patient can be transferred into and out of the bed without problems. The lower members 18" of the legs 18 have spinning supports 24 for support wheels 24' for moving the gurney.

Figure 3:
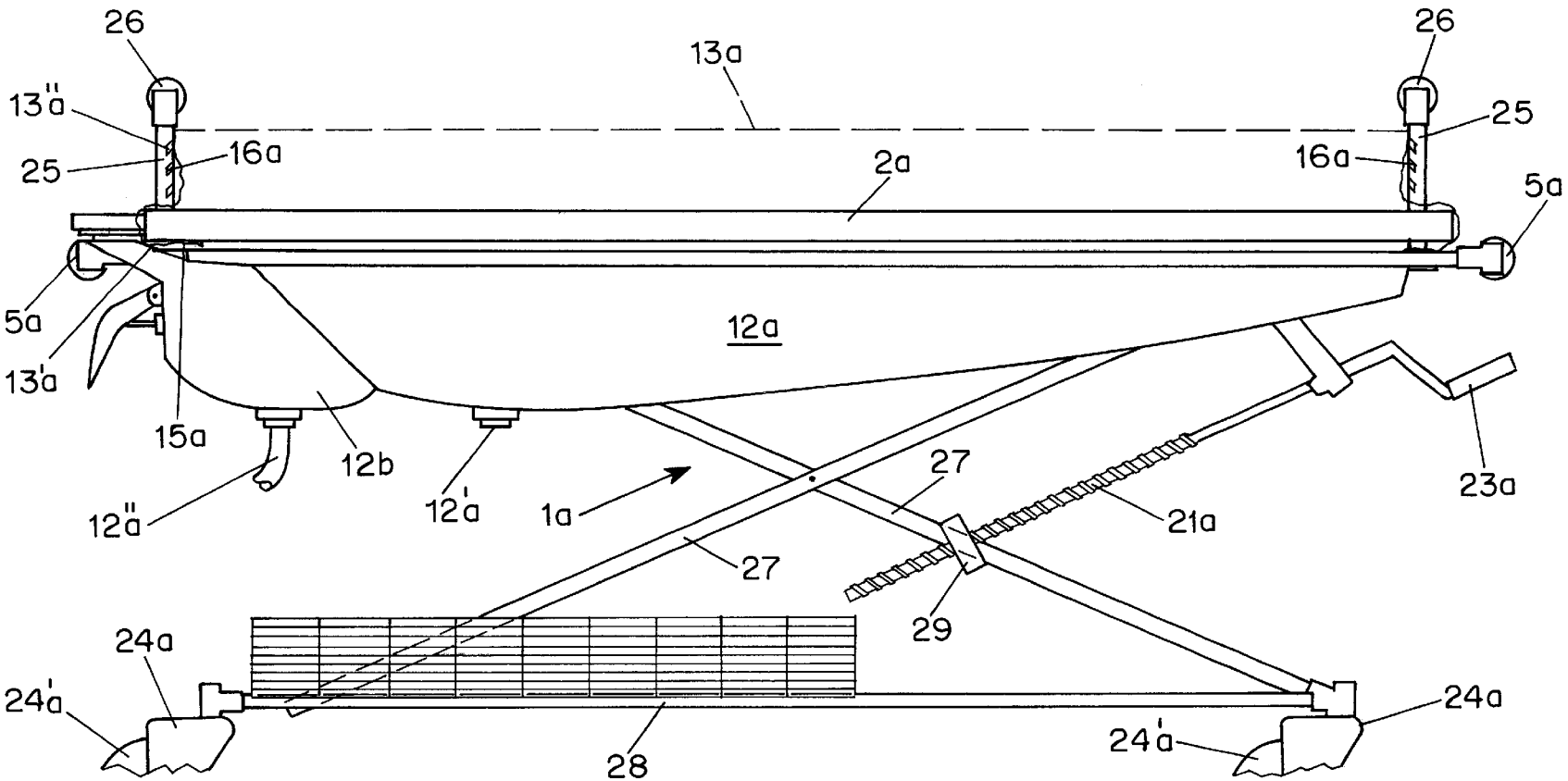
FIG. 3 is an elevation view of a second embodiment of the gurney of the present invention.
Figure 4:
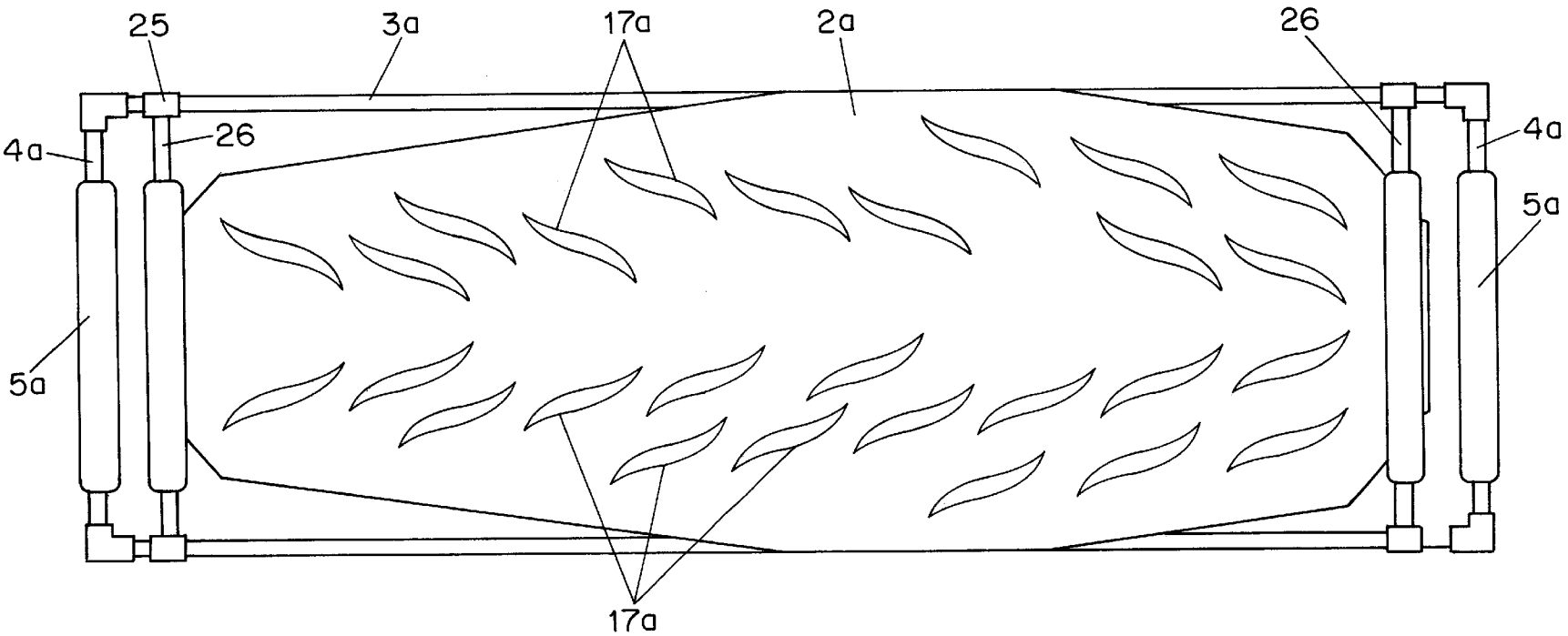
FIG. 4 is a plan view of the gurney of FIG. 3.

FIGS. 3 and 4 show a second embodiment of the gurney that includes a support structure la which has a rectangular frame 3*a* to support a polygonal table 2*a* with openings or holes 17*a*.

Affixed to frame 3*a* is a pair of containers 12*a* and 12*b* of which container 12*a* is opened at the top and connected beneath table 2*a*. Container 12*a* has a drain 12'*a* at one end, and container 12*b* has a water pump mechanism (not shown) deployed through conduit tube 12"*a* for delivering cleaning fluid.

Frame 3*a* includes transverse bars 5*a* at its short sides to push the gurney attached to extensions 4*a* of the longitudinal sides of frame 3*a*. Frame 3*a* further includes vertical bars 25 with rows of notches or grooves 16*a*, the vertical bars being joined by crossbars 26 with handles. As in the previous configuration, the lower portion 13'*a* of laminar material piece 13*a* is affixed between the underside of table 2*a* and the upper surface of frame 3*a*. The upper edge 13"*a* of laminar piece 13*a* can be placed into notches 16*a* of the vertical bars 25 to form a wall to confine the patient during washing. This laminar piece 13*a* can be folded below table 2*a* when the patient is transferred to the gurney or to the bed.

Laminar piece 13*a* is affixed as in the preceding embodiment by thumbscrews 15*a*, to frame 3*a*, through table 2*a*.

The gurney support 1*a* in this configuration is comprised of tubes or bars 27 crisscrossed diagonally, affixed on one side to frame 3*a* and on the other to a lower assembly 28, having spinning supports 24*a*, with wheels 24'*a* for moving the gurney. A nut 29 for receiving a threaded bar 21*a* is attached to a tube on bar 27 which allows the height of the bed to be changed using a handle 23*a*.

In both embodiments, the patient is washed in the space delimited by laminar piece 13, 13*a*, and the fluid is drained through openings or holes 17, 17*a* of table 2, 2*a*. Once cleaned, the patient is dried in the gurney, preferably using an air dryer, so as then to transfer the patient to his bed.

The second embodiment is particularly applicable to hospitals, nursing homes or old age homes because its general structure is fixed.

What is claimed is:

1. A gurney for cleaning patients confined to bed comprising:

a horizontal support table having openings;

a container having a drain, the container being deployed below the table and having a mouth edge that follows the perimetral edge of the table whereby washing fluid can pass through the table openings to the container;

a frame for affixing the table and the container, the frame comprising longitudinal sides, support legs and wheels for moving along the floor, the legs being comprised of hinged members connected in the middle to permit the folding of the legs to position the table at a level to enable transfer of the patient to or from the table;

a laminar material piece that surrounds the table comprising flexible and foldable walls, with a lower edge of the laminar material piece attached to the frame coextensively with the perimeter of the table whereby the table forms the bottom of a basin for washing the patient, the laminar piece being positioned such that in a folded position it extends below and surrounds the table and, in an unfolded position, it extends above the table to form a space for washing the patient; and extensions at opposite ends of the respective longitudinal sides of the frame extending vertically above the aforementioned table and joined at each end of the frame by transversal bars, the extensions having respective rows of notches in which the upper edge of the laminar piece in the unfolded position can be selectively positioned with respect to the table.

2. A gurney pursuant to claim 1 wherein the extensions of the longitudinal sides of the frame are U-shaped having the arms of the U-shape projecting vertically and on an incline, coplanarly with the longitudinal sides of the frame, the arm of each extension furthest from the end of the frame extending above the table to form a free end portion and having the row of notches.

3. A gurney pursuant to claim 1 wherein the extensions of the longitudinal sides of the frame comprise respective vertical bars projecting perpendicularly from each end of the frame sides and having the respective rows of notches.

* * * * *